US006276820B1

(12) United States Patent
Howell et al.

(10) Patent No.: US 6,276,820 B1
(45) Date of Patent: Aug. 21, 2001

(54) HANDLE FOR SURGICAL LIGHT APPARATUS

(75) Inventors: Charles A. Howell, Batesville, IN (US); Thomas M. Peterson; Dennis Coon, both of Erie, PA (US); Richard L. Borders, Cincinnati, OH (US)

(73) Assignee: Hill-Rom, Inc., Batesville, IN (US)

( * ) Notice: Subject to any disclaimer, the term of this patent is extended or adjusted under 35 U.S.C. 154(b) by 0 days.

(21) Appl. No.: 09/377,483

(22) Filed: Aug. 19, 1999

(51) Int. Cl.[7] ..... F21V 21/08
(52) U.S. Cl. ..... 362/399; 362/804; 16/906
(58) Field of Search ..... 362/33, 399, 400, 362/804; 16/110.1, 111.1, 903, 906

(56) References Cited

U.S. PATENT DOCUMENTS

| | | | |
|---|---|---|---|
| D. 214,188 | | 5/1969 | Lauterbach . |
| D. 221,103 | | 7/1971 | Beach et al. . |
| D. 221,247 | | 7/1971 | Beach et al. . |
| D. 260,042 | | 7/1981 | Brendgord . |
| D. 297,056 | | 8/1988 | Sestack . |
| D. 300,950 | | 5/1989 | Richard . |
| D. 336,146 | | 6/1993 | Yamada et al. . |
| D. 343,914 | | 2/1994 | Wingate . |
| D. 399,022 | | 9/1998 | Jensen et al. . |
| 2,215,531 | | 9/1940 | Pieper . |
| 2,809,281 | | 10/1957 | Greppin . |
| 2,896,066 | | 7/1959 | Quetin . |
| 2,911,518 | | 11/1959 | Anderson . |
| 3,360,640 | * | 12/1967 | Seitz ..... 362/804 |
| 3,786,244 | | 1/1974 | Hutter, III . |
| 4,032,775 | | 6/1977 | Bobrick et al. . |
| 4,037,096 | | 7/1977 | Brendgord et al. . |
| 4,196,460 | | 4/1980 | Schreckendgust . |
| 4,380,790 | | 4/1983 | Saferstein et al. . |
| 4,494,177 | * | 1/1985 | Matthews ..... 362/177 |
| 4,517,632 | | 5/1985 | Roos . |
| 4,646,205 | | 2/1987 | Schumaker . |
| 4,761,719 | | 8/1988 | Yamada . |
| 4,837,668 | | 6/1989 | Koehler . |
| 4,930,058 | | 5/1990 | Jones et al. . |
| 4,975,810 | | 12/1990 | Vanderbel . |
| 5,510,963 | * | 4/1996 | Bamber et al. ..... 362/399 |
| 5,685,421 | * | 11/1997 | Gilmore ..... 362/156 |
| 5,808,680 | | 9/1998 | Steckhan . |
| 5,820,253 | | 10/1998 | Scholz . |

FOREIGN PATENT DOCUMENTS

| | | | | |
|---|---|---|---|---|
| 503313 | * | 12/1946 | (CA) | 362/804 |
| 650587 | * | 10/1962 | (CA) | 362/33 |
| 2305664 | * | 8/1974 | (DE) | 362/33 |

* cited by examiner

*Primary Examiner*—Sandra O'Shea
*Assistant Examiner*—Peggy A Neils
(74) *Attorney, Agent, or Firm*—Barnes & Thornburg

(57) ABSTRACT

A surgical lighthead is provided with an outer cover, an inner reflective component, and handles disposed in recesses in the outer cover. The handles do not extend substantially beyond the outer surface of the outer cover. The recesses in the outer cover are spaced apart from the inner component. The handles and recesses are formed by multi-component handle assemblies shrink fit to eliminate gaps in the seams between the components.

23 Claims, 5 Drawing Sheets

HANDLE FOR SURGICAL LIGHT APPARATUS

BACKGROUND AND SUMMARY OF THE INVENTION

The present invention relates to a medical procedure or surgical light apparatus, and particularly, to a handle for a medical procedure or surgical light apparatus. More particularly, the present invention relates to a handle formed adjacent a recess in the outer cover of the light for positioning the light onto a surgical or procedural site.

Surgical lights used in hospital operating rooms to illuminate surgical sites on patients and procedural lights for providing illumination for medical procedures are known. Many surgical and procedural lights are suspended from a ceiling of a hospital room by arm mechanisms which are movable to permit adjustment of the location of the surgical or procedural light relative to the patient. It is common for surgical and procedural lights to be placed in a position behind a surgeon or caregiver such that the surgeon or caregiver's head is located between the light and the site to be illuminated. Surgical and procedural lights having a dome-shaped reflector encased in a dome-shaped outer cover are known. It is desirable for surgical and procedural lights to be positionable to provide a high illuminance level, to shine light deeply into a patient's body cavity, and to resist shadowing caused by interference from personnel and instruments.

According to the present invention, a surgical or procedural lighthead includes a concave inner component providing a reflective surface and an outer cover disposed over the inner component to provide a space therebetween. The outer cover is formed to include one or more recesses extending inwardly toward the inner component and providing a space for a handle which is at least partially disposed in the recess.

In preferred embodiments, a plurality of recess are formed in the outer cover each having a handle partially disposed therein. Each handle extends only partially beyond the outer surface of the cover to reduce the likelihood of inadvertent contact with the handle by a caregiver during a procedure. The recess is spaced apart from the inner component to reduce the transfer of heat generated by the light to the handle.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The handle of the present invention provides a location for gripping a surgical or medical light outside of the illumination field of the light to facilitate repositioning the light. The handle is partially disposed in a recess formed in an outer cover of the light to reduce the likelihood of a healthcare provider inadvertently contacting the handle and repositioning the light. While the description herein refers specifically to a surgical light, it should be understood that other medical procedural lights are within the scope of the invention.

Figure 1:
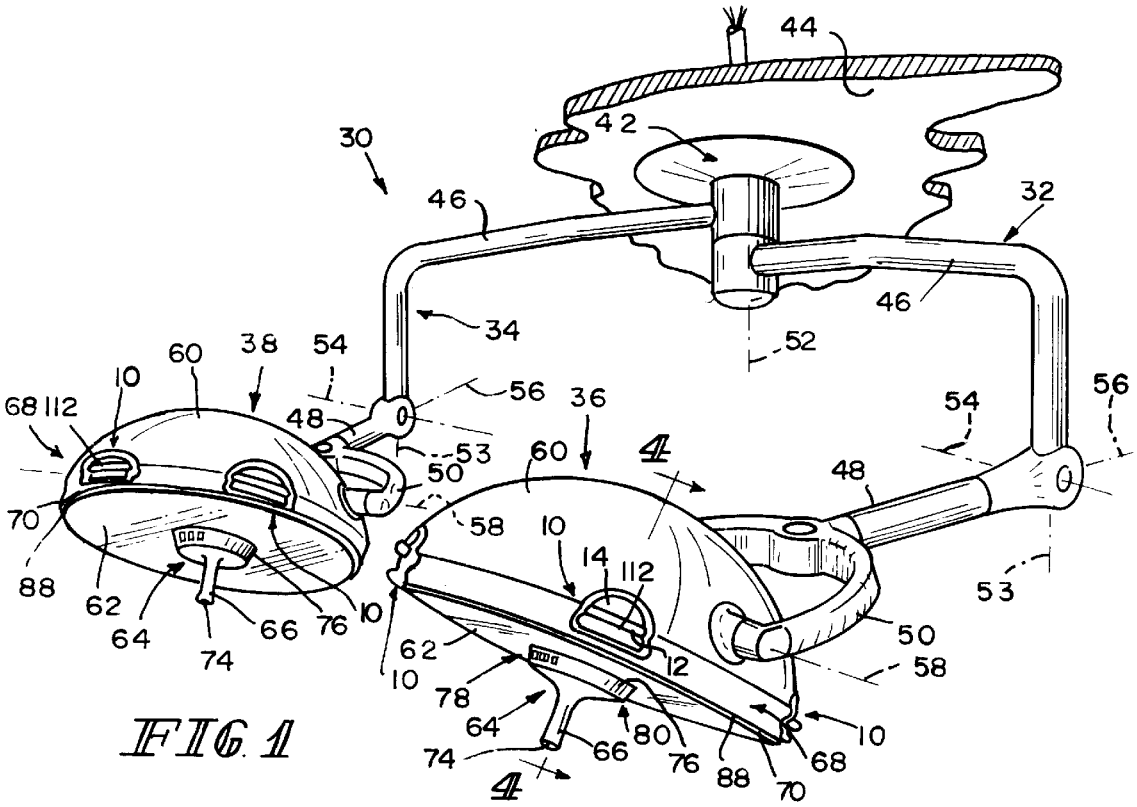
FIG. 1 is an isometric view of a surgical light apparatus in accordance with the present invention showing a first surgical lighthead suspended from a ceiling of a hospital room by a first arm assembly, a second surgical lighthead suspended from the ceiling of the hospital room by a second arm assembly, and showing each lighthead including a plurality of handle assemblies formed in an outer dome-shaped cover.
Figure 2:
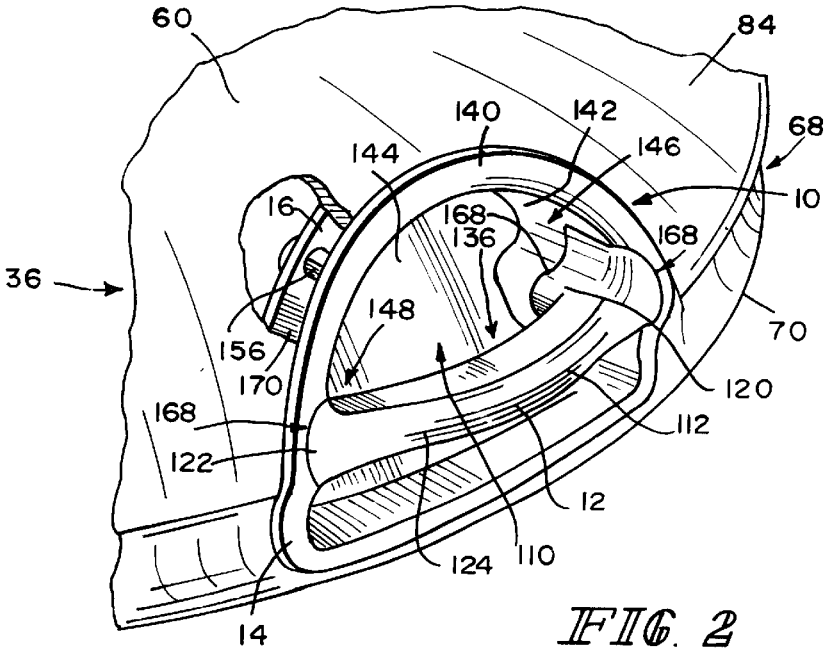
FIG. 2 is a partially broken away perspective view of one of the handle assemblies and adjacent portions of the outer cover of FIG. 1 showing a handle portion of the handle assembly extending across a recess portion of the handle assembly with the recess portion received in and enclosing an aperture in the outer cover, and also showing an inner portion of the handle assembly securing the recess portion to the outer cover.

A surgical light apparatus 30 includes a first arm assembly 32, a second arm assembly 34, a first lighthead 36 coupled to first arm assembly 32, and a second lighthead 38 coupled to second arm assembly 34 as shown in FIG. 1. First and second arm assemblies 32, 34 each couple to a common mounting apparatus 42 which is configured to mount to suitable support structure (not shown) associated with a ceiling 30 44. Each arm assembly 32, 34 includes an L-shaped upper arm 46, a lower arm 48, and a yoke 50. Each upper arm 46 is independently pivotable relative to mounting apparatus 42 about a vertical pivot axis 52. Each lower arm 48 is pivotable relative to the respective upper arm 46 about a respective horizontal pivot axis 54 and about a respective vertical pivot axis 53 that is spaced apart from pivot axis 52. In addition, each yoke 50 is pivotable relative to the respective lower arm 48 about a respective pivot axis 56 and each of lightheads 36, 38 is pivotable relative to the respective yoke 50 about a respective pivot axis 58. Thus, arm assemblies 32, 34 and lightheads 36, 38 are movable to a variety of positions relative to ceiling 44.

Figure 4:
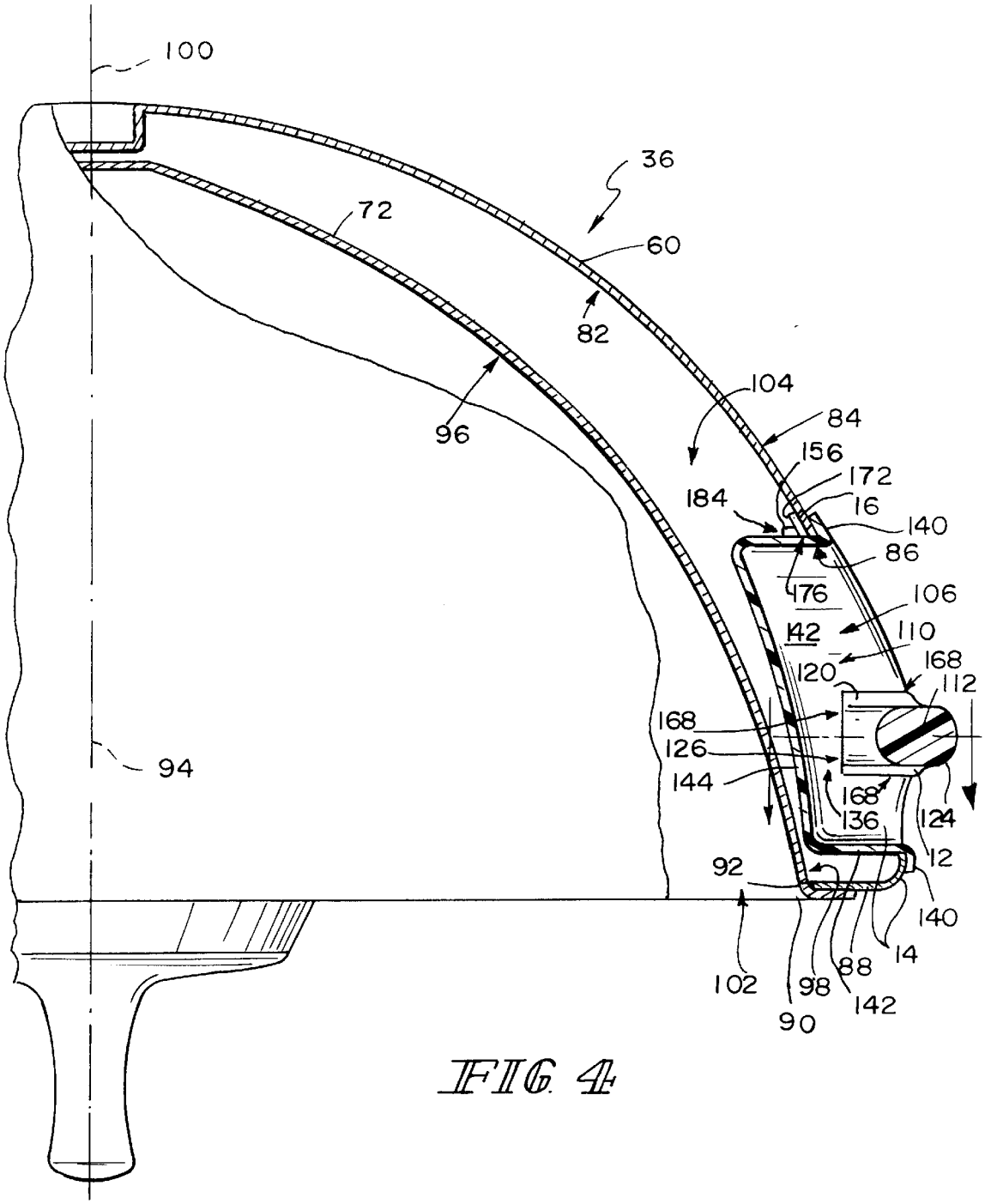
FIG. 4 is a partial sectional view of the first surgical lighthead of FIG. 1, taken along line 4—4, showing the dome-shaped outer cover, a dome-shaped reflector surrounded by the outer cover, and one of the handle assemblies including a handle portion extending across a recess formed in the outer cover by a recess portion, and the inner portion secured to the recess portion with outer cover sandwiched therebetween.

Each lighthead 36, 38 includes a dome-shaped housing, shell, or cover 60, a lens 62 through which light shines from the respective lighthead 36, 38, a central handle assembly 64, and a plurality of peripheral handle assemblies 10 as shown in FIG. 1. Each central handle assembly 64 includes a handle 66 which may be grasped by a surgeon to move the respective lighthead 36, 38 and associated arm assembly 32, 34 to a desired position. In addition, each lighthead 36, 38 includes a reflector 72 that reflects light emanating from a bulb (not shown) to illuminate a surgical site on a patient as shown in FIG. 4 with reference to surgical lighthead 36.

The description below of lighthead 36 and the operation of lighthead 36 applies as well to lighthead 38 and the operation of lighthead 38 unless specifically noted otherwise. In addition, although surgical light apparatus 30 includes two arm assemblies 32, 34 and two lightheads 36, 38 as shown in FIG. 1, it is within the scope of the invention as presently perceived for a different number of arm assemblies and corresponding lightheads to be provided. For example, a surgical light apparatus having only one arm assembly and one corresponding lighthead and a surgical light apparatus having three or more arm assemblies and three or more corresponding lightheads are possible.

Handle 66 of each central handle assembly 64 is rotatable to move the bulb (not shown) relative to reflector 72 to adjust the pattern size of reflected light that illuminates the surgical site. The pattern size may be thought of generally as the diameter of the area illuminated by the associated lighthead 36, 38. In addition, central handle assembly 64 includes a button 74 at the bottom of handle 66 which is pressed to adjust the intensity level at which light emanates from the bulb (not shown). Central handle assembly 64 includes an escutcheon 76 above handle 66. Central handle assembly 64 further includes a first set of LED's 78 and a second set of LED's 80 that are visible on respective sides of escutcheon 76 to provide user information regarding whether the bulb (not shown) is in use or in a standby mode, whether the bulb (not shown) is operative, and the intensity level at which light is emanating from the bulb (not shown). In preferred embodiments, the bulb (not shown) is a tungsten halogen lamp or a main and a redundant tungsten halogen lamp.

Other features of surgical light apparatus 30 are discussed and shown in detail in co-pending U.S. patent applications Ser. No. 09/050,530 entitled Support Arm for Surgical Light Apparatus; Ser. No. 09/050,529 entitled Surgical Light Apparatus with Improved Cooling; Ser. No. 09/050,539 entitled Controls for Surgical Light Apparatus; and Ser. No. 09/050,576 entitled Task Light for Surgical Light Apparatus, all of which are incorporated by reference. Each of the incorporated applications are owned by the assignee of the present application.

Lighthead 36 of surgical light apparatus 30 includes reflector 72 as previously described. Reflector 72 includes a concave reflector surface 96 and an outer periphery surface 98, shown for example in FIG. 4. In preferred embodiments, reflector 72 is made from a sheet of metal, such as aluminum, that is spun or otherwise formed into the desired shape and that is anodized, vacuum-metalized, or otherwise treated, if necessary, to provide concave reflector surface 96 with a mirror-like finish. Reflector 72 is somewhat dome-shaped and, therefore, has a central axis 100. Reflector 72 is shaped so that concave reflector surface 96 follows a generally elliptical curve. In preferred embodiments, reflector 72 has a lower peripheral opening 102 with a diameter of twenty-three inches (58.4 cm).

Dome-shaped outer cover 60 includes an inner surface 82, an outer peripheral surface 84, a plurality of aperture walls 86, a radially inwardly extending bottom wall 88 defining a lower opening 90 at its inner edge 92, and a central axis 94. 25 In preferred embodiments, outer cover 60 is made from a sheet of metal, such as aluminum, that is spun or otherwise formed into the desired shape. In the illustrated embodiment, dome-shaped outer cover 60 is generally hemispherically shaped with an annular indentation 68 and an outwardly extending lip 70 formed near lower opening 90, as shown for example in FIGS. 1–4. Bottom wall 88 extends radially inwardly from lip 70 and is coupled adjacent its inner edge 92 to reflector 72 as shown, for example, in FIG. 4. Central axis 100 of reflector 72 and central axis 94 of outer cover 60 are coaxial so that reflector 72 is received within and spaced apart from cover 60. Outer periphery surface 98 of reflector 72 and inner surface 82 and bottom wall 88 of outer cover 60 define a space 104 between reflector 72 and outer cover 60.

In the illustrated embodiment, each aperture wall 86 extends between inner surface 82 and outer surface 84 to define an aperture 106. Adjacent each aperture 106 are a plurality of connection holes 108 to facilitate attachment of a handle assembly 10 to outer cover 60. A handle assembly 10 is received in each aperture 106 to form a recess 110 with a handle 112 at least partially disposed in the recess 110. In the illustrated embodiment recesses 110 are formed by inserting separate handle assemblies 10 into apertures 106, however, it should be understood that recesses 110 and handles 112 integrally formed in outer cover 60 are within the teaching of the disclosure. Thus it would be appropriate to consider outer cover to include both outer cover or shell 60 and handle assembly 10.

In the illustrated embodiment, outer cover 60 is designed to receive four peripheral handle assemblies 10, one of which is obscured in FIG. 1. Thus, a handle 112 is located in each quadrant of cover 60 for access by a caregiver. Each handle assembly 10 includes a handle portion 12, a recess portion 14, and an inner portion 16 as shown, for example, in FIG. 3. Handle portion 12 is coupled to and extends across recess 110 formed in recess portion 14 as shown, for example in FIGS. 2–5. Inner portion 16 is secured to recess portion 14 with outer cover 60 sandwiched therebetween.

Figure 3:
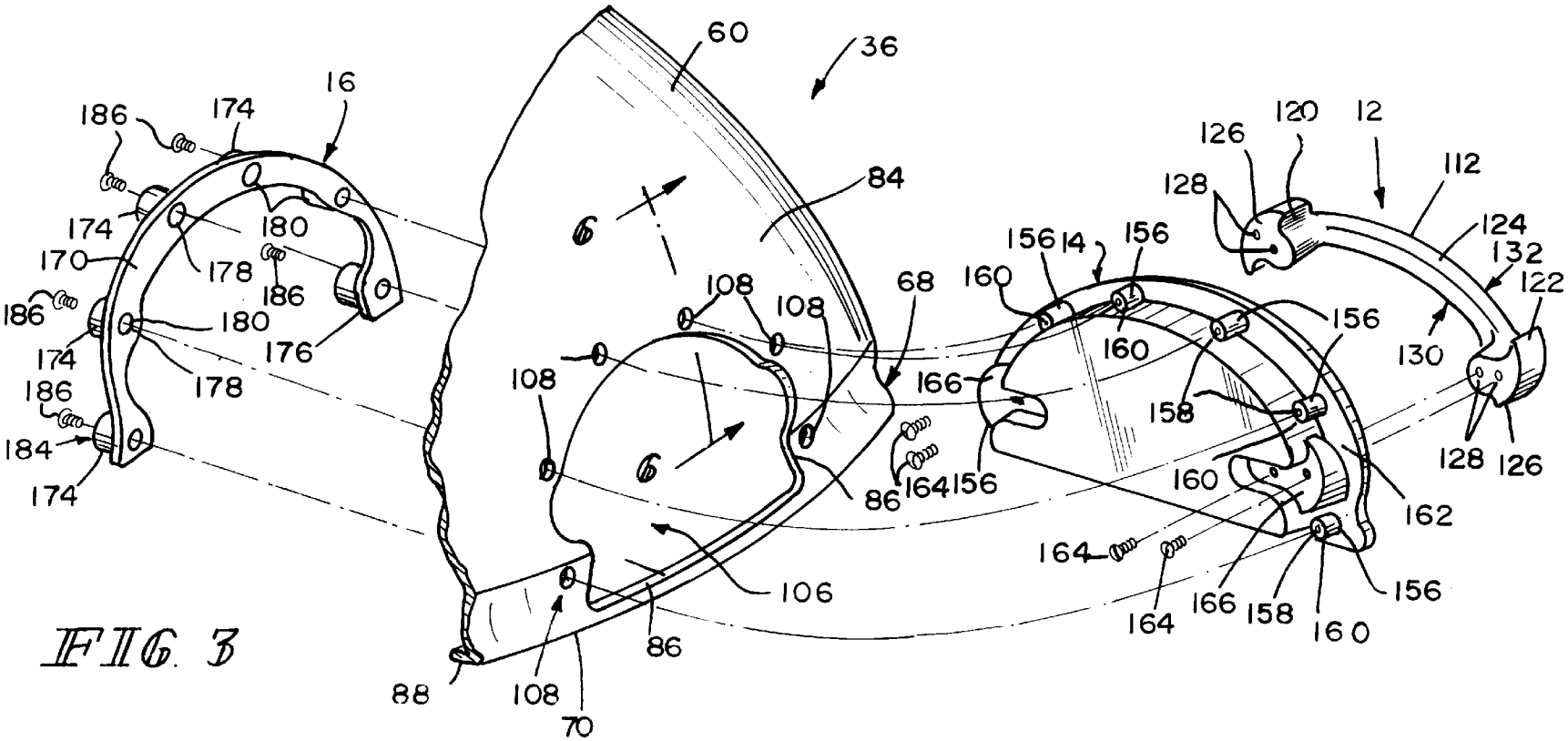
FIG. 3 is a partially exploded view of one of the handle assemblies and the dome-shaped outer cover showing the aperture and connection holes formed in the outer cover, the handle portion formed to include two attachment holes on opposite ends, the recess portion formed to include four handle attachment holes and a plurality of bosses extending inwardly from a peripherally extending dome-engaging flange each boss being formed to include attachment holes, an inner portion formed to include boss-receiving apertures each of which includes attachment holes, fasteners for extending through handle attachment holes in recess portion and into attachment holes in handle portion to secure handle portion to recess portion, and fasteners for extending through attachment holes in inner portion and recess portion to secure inner portion to recess portion with outer cover sandwiched therebetween
Figure 5:
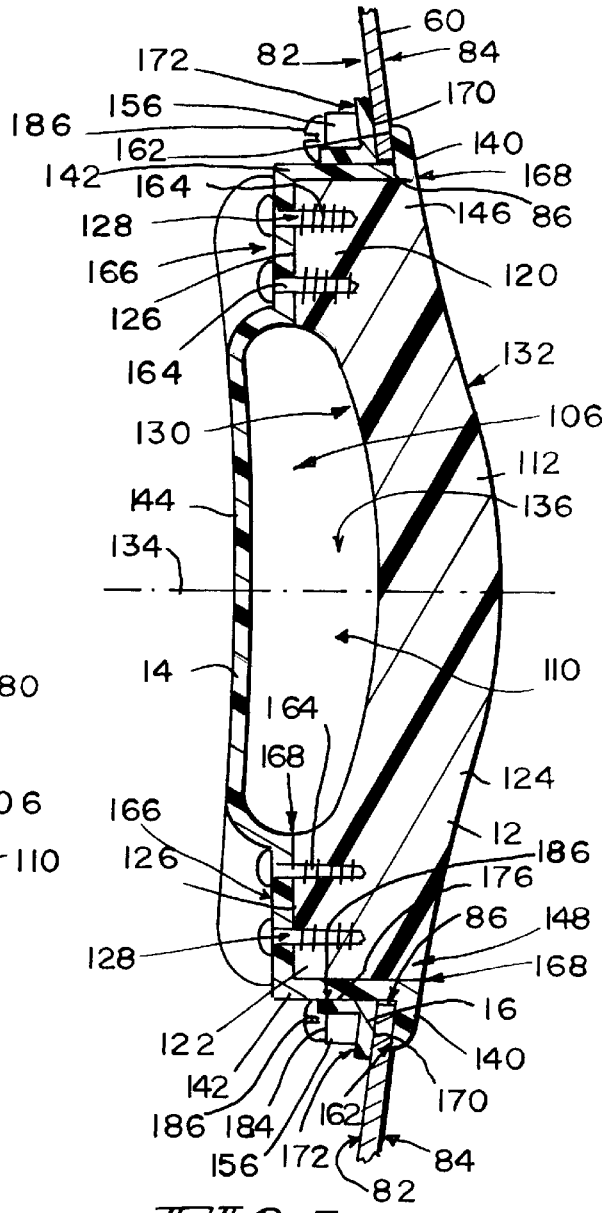
FIG. 5 is a partial sectional view of the first surgical lighthead of FIG. 4 taken along line 5—5.

Handle portion 12 includes a first end portion 120, a second end portion 122, and a grip or grip portion 124 extending between and coupling first and second end portions 120, 122. First and second end portions 120, 122 include a substantially flat engaging surface 126 formed to include two attachment holes 128. In the illustrated embodiment, first and second end portions 120, 122 are generally bell shaped as is best seen in FIG. 3. Grip portion 124 includes a recess-facing surface 130 and an outer surface 132. In the illustrated embodiment, handle portion 12 is symmetrical about an axis 134 passing through center of handle portion, as shown in FIG. 5. Illustratively, handle portion 12 is formed by injection molding tough plastic material such as ST 801 nylon and is shaped to facilitate injection molding.

Figure 7:
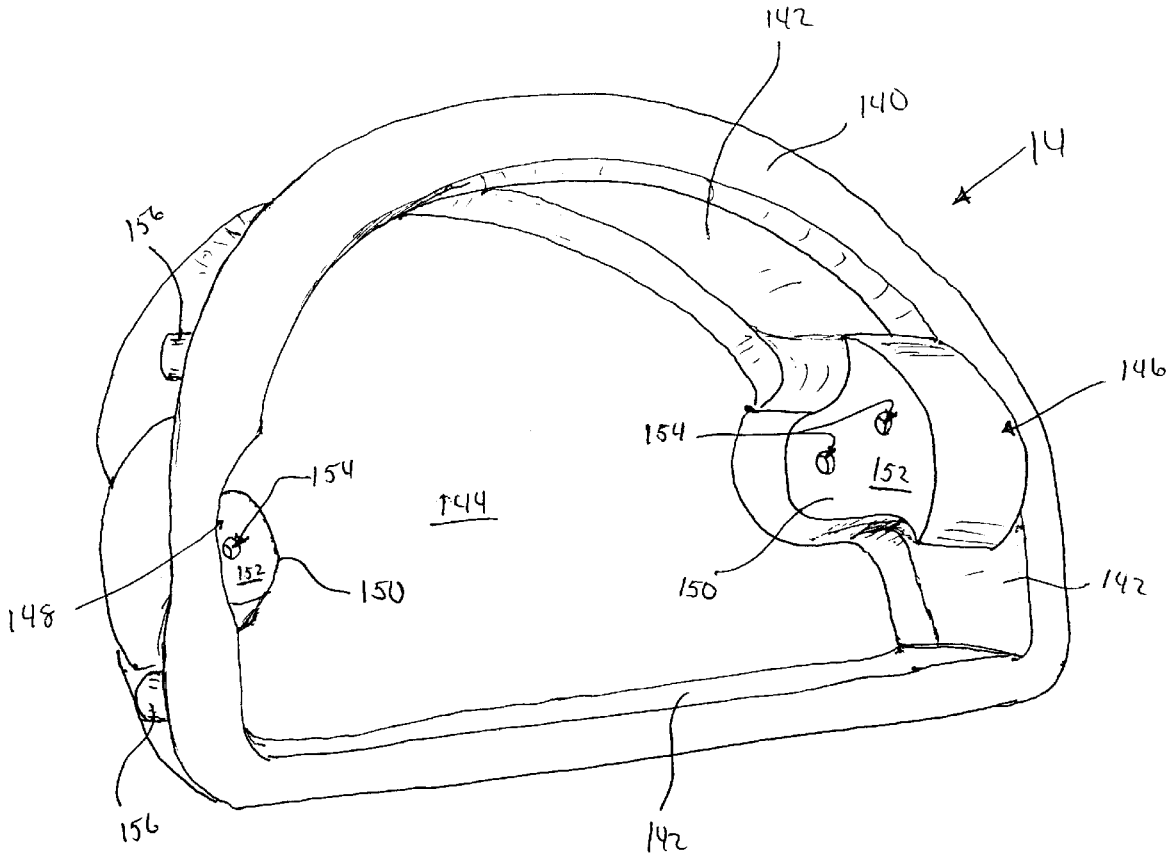
FIG. 7 is a perspective view of the recess portion of the handle assembly of FIG. 2 showing bell-shaped mesas with attachment holes extending therethrough to facilitate attachment of the handle portion and bosses extending inwardly from the flange for coupling the recess portion to the inner portion.

Recess portion 14 includes a peripherally extending dome-engaging flange 140, an inwardly extending wall 142, and a base wall 144. Inwardly extending wall 142 and base wall 144 are joined to define enclosed substantially hemicircular recess 110. At opposite ends 146, 148 of recess 120, inwardly extending wall 142 and base wall 144 are formed to include a mesa 150 having an outwardly facing substantially flat bell-shaped surface 152 to receive first and second end portions 120, 122 of handle portion 12, as shown, for example, in FIG. 7. Two handle attachment holes 154 are formed in each flat surface 152 arranged to facilitate coupling of handle portion 12 to recess portion 14.

Flange 140 is formed to include a plurality of cylindrical bosses 156 each of which is formed to include an attachment hole 158 extending through a flat end surface 160 of the respective boss 156, as shown, for example, in FIG. 3. Each boss 156 extends inwardly from cover-engaging surface 162 of flange 140. Each boss 156 is sized and positioned to be received in and extend through one of the connection holes 108 adjacent each aperture 106 to facilitate coupling of recess portion 14 to cover 60. Cover-engaging surface 162 of flange 140 is formed to have the general shape of outer surface 84 of outer cover 60 adjacent to aperture 106 and inwardly extending wall 142 is formed to have the general shape of aperture 106 to facilitate mating of recess portion 14 with outer cover 60.

Handle portion 12 is coupled to recess portion 14 so that a portion of handle 112 is received within recess 110. Grip portion 124 of handle portion 12 is curved so that recess facing surface 130 is concave and outer surface 132 is convex. In the illustrated embodiment recess facing surface 130 and back wall 144 of recess define a finger-receiving channel 136 disposed entirely within recess 110. Because of the concavity of recess facing surface 130, finger receiving channel 136 is sufficiently wide to receive the fingers of a caregiver while allowing the entire recess portion 14 to remain spaced apart from reflector 72, as shown for example in FIG. 4. This spacing reduces the transfer of heat generated by the light between reflector 72 and recess portion 14 and handle portion 12 of handle assembly 10.

In the illustrated embodiment, inner portion 16 is sickle-shaped and includes a cover-engaging surface 170, an inner surface 172, a plurality of cylindrical fingers 174 extending inwardly from inner surface 172, and a curved wall 176 extending between cover-engaging surface 170 and inner surface 172. Cover-engaging surface 170 of inner portion 16 is formed to have the general shape of inner surface 82 of outer cover 60 adjacent to aperture 106. Curved wall 176 is formed to have the general shape of aperture 106 to facilitate mating of inner portion 16 and recess portion 14 with outer cover 60.

Figure 6:
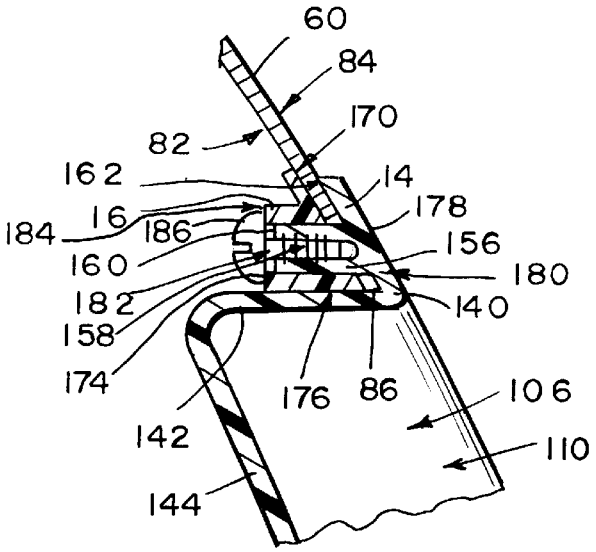
FIG. 6 is a sectional view taken through line 6—6 of FIG. 3 of one of the bosses extending from the flange of the recess portion received in a cavity formed in a finger of the inner portion showing a portion of the outer cover adjacent the aperture in the cover sandwiched between the recess portion and inner portion which are secured together with a fastener.

Each cylindrical finger 174 is formed to include a boss-receiving cavity 178 opening through a boss-receiving aperture 180 formed in cover-engaging surface 170. Each finger 174 is positioned along inner portion 16 and each cavity 178 therein is formed, oriented, and sized to receive one of the inwardly extending bosses 156 of recess portion 14. Each finger 174 is formed to include an attachment hole 182 extending through flat end surface 184 in communication with cavity 178 to facilitate coupling of inner portion 16 to recess portion 14 with fasteners 186, as shown, for example, in FIGS. 3 and 6.

In the illustrated embodiment, handle 12, recess 14, and inner 16 portions of handle assembly 10 are all formed from tough plastic material, illustratively ST 801 Nylon and are thus substantially rigid. However, it is within the scope of the invention as presently perceived for other plastic materials, such as urethane, or other rigid materials, such as metal material or any variety of composite materials, to be used to construct components of handle assembly 10. The rigidity of recess portion 14 and inner portion 16 help to reinforce outer cover 60 in the vicinity of apertures 106 so that forces exerted by a user do not induce deformation of outer cover 60. Annular indent 68, lip 70, and bottom wall 88 of outer cover 60 also aid in preventing deformation of outer cover by forces exerted during repositioning of surgical lighthead.

As can best be seen in FIG. 5, outer surface 132 of handle portion 12 extends only slightly radially outwardly beyond outer surface 84 of outer cover 60. However, handle portion 12 could be formed so that no portion of outer surface 132 of handle portion 12 extends radially beyond outer surface 84 of outer cover 60 within the teaching of the invention. Because no portion of handle 112 extends outwardly substantially beyond outer surface 84 of outer cover 60, surgeons and other health care providers assisting in a surgical procedure are less likely to accidentally reposition light 30 by bumping against handle 112.

In the preferred method of manufacturing lightheads 36, 38, a cover 60 with apertures 106 surrounded by attachment holes 108 is provided. Handle portions 12 are provided by molding and are allowed to cool. A recess portion 14 is formed by molding. The recess portion is shaped to be received in aperture 106 and configured to receive handle portion 12.

Prior to cooling of recess portion, first and second end portions 120, 122 of handle portion 12 are received in recess 140 so that flat surfaces 126 of first and second end portions 120, 122 abut flat surfaces 152 at opposite ends 146, 148 of recess 110 respectively. Handle portion 12 is attached to recess portion 14 by fasteners 164, such as screws, extending through attachment holes in flat surfaces 152, 126 of recess portion 14 and handle portion 12 respectively. It should be understood that heads of fasteners engage inner surface 166 of bell-shaped flat surface of recess portion 14. Since flat surface 126 of end portions 120, 122 of handle portion 12 and flat surface 152 of recess portion 14 are both generally bell-shaped, when handle and recess portion 14 are coupled together interior of recess 110 has no edges which might damage surgical gloves of a user. After coupling of handle portion 12 to recess portion 14, recess portion 14 is allowed to cool and shrink. Shrinkage of recess portion 14 causes the seams 168 to be very tight thereby inhibiting bacterial growth in the seams 168.

Recess portion 14 is oriented so that the plurality of bosses 156 align with the plurality of connection apertures 108 formed adjacent aperture 106 and recess portion 14 is inserted through aperture 106. Each boss 156 extends through an appropriate connection hole 108 with the flat end 160 of boss 156 disposed inwardly from inner surface 82 of outer cover 60. Inner portion 16 is oriented so that the plurality of boss-receiving cavities 178 formed in fingers 174 are aligned with the plurality of bosses 156 and inner portion 16 is urged against inner surface 82 of outer cover 62. Each boss 156 is received in an appropriate boss-receiving cavity 178 formed in a finger 174. Fasteners 186, such as screws, are inserted through attachment holes 182, 158 in each finger 174 and corresponding boss 156 to secure inner portion 16 to recess portion 14. As screws 186 are tightened, cover-engaging surface 170 of inner portion 16 and cover-engaging surface 162 of flange 140 of recess portion 14 are urged into contiguous engagement with inner and outer surfaces 82, 84 of outer cover 60, respectively. Thus, cover 60 is sandwiched between inner portion 16 and flange 140 of recess portion 14.

Although the invention has been described in detail with reference to a certain preferred embodiment, variations and modifications exist within the scope and spirit of the invention as described and as defined in the following claims.

What is claimed is:

1. A light for use in a medical procedure, said light comprising:

an inner component providing a reflective surface, said inner component being concave, an outer cover disposed over the inner component to provide a space therebetween, said outer cover having a plurality of surfaces defining a recess extending inwardly toward the inner component, and a handle being at least partially disposed in the recess, a finger-receiving channel being defined between the handle and a first surface of the plurality of surfaces and the plurality of surfaces including surfaces that are positioned above, below and on opposite ends of the finger-receiving channel.

2. The apparatus of claim 1 wherein the outer cover comprises a shell formed to include an aperture and a handle assembly received in the aperture to define the recess.

3. The apparatus of claim 2 wherein the handle assembly is coupled to the shell to form a contiguous outer surface.

4. The apparatus of claim 2 wherein the handle assembly is spaced apart from the inner component.

5. The apparatus of claim 2 wherein the handle assembly includes a recess portion sized to be received in the aperture and a handle portion coupled to the recess portion.

6. The apparatus of claim 1 wherein the outer cover includes a plurality of recesses with handles partially disposed therein.

7. The apparatus of claim 6 wherein the outer cover includes a shell formed to include a plurality of apertures and a plurality of handle assemblies received in the apertures to form the plurality of recesses.

8. The apparatus of claim 7 wherein the outer cover includes four quadrants and a handle assembly is located within each quadrant.

9. A medical procedure light comprising:

an inner component providing a generally concave reflector surface, the inner component having a center axis and an outer periphery, an outer component disposed generally coaxially over the inner component and having an outer periphery spaced radially outwardly from the outer periphery of the inner component, said outer component having a plurality of radially inwardly extending recesses adjacent the outer periphery, and a plurality of handles, each handle of the plurality of handles being arranged in a plane that is perpendicular to the center axis, each handle of the plurality of handles being disposed at least partially in each respective recess, a finger-receiving channel being defined between each handle and a first portion of each recess, a second portion of each recess overhanging at least a portion of the respective finger-receiving channel, and a third portion of each recess underlying at least a portion of the respective finger-receiving channel.

10. The apparatus of claim 9 wherein each handle includes a recess facing surface and an outer surface and the entire recess facing surface is disposed in the recess.

11. The apparatus of claim 9 wherein the outer component includes a shell formed to include a plurality of apertures and a plurality of handle assemblies each having a concavity received in one of the plurality of apertures to form the plurality of recesses and the plurality of handles disposed at least partially in the recesses.

12. The apparatus of claim 11 wherein the shell and handle assemblies form a contiguous outer surface spaced apart from the inner component.

13. The apparatus of claim 12 wherein each handle assembly includes a flange extending from the concavity and the flange engages the shell adjacent the aperture.

14. The apparatus of claim 9 wherein each handle assembly includes an inner portion and a recess portion including the flange and concavity and the inner portion is coupled to the recess portion with a portion of the shell adjacent the aperture disposed between the inner portion and the flange of the recess portion.

15. A surgical light apparatus comprising an outer cover, an illumination system coupled to the outer cover, a concave surface defining a recess in the outer cover, the recess having a first side and a spaced apart second side, and a grip extending between the first and second sides of the recess, a finger-receiving channel being defined between the grip and a first portion of the concave surface, a second portion of the concave surface extending between the first and second sides of the recess and overhanging at least a portion of the finger-receiving recess.

16. The apparatus of claim 15 wherein the outer cover includes a shell having an exterior surface, an interior surface, and an aperture wall extending between exterior surface and interior surface to define an aperture and a handle assembly having a wall defining the recess and a handle portion defining the grip, the handle assembly being received in the aperture.

17. The apparatus of claim 16 wherein the handle assembly includes a recess portion defining the recess and a flange extending beyond the recess and wherein the flange, wall, and shell define a contiguous surface spaced apart from the illumination system.

18. A method of assembling a surgical lighthead comprising the steps of:

providing an outer cover formed to include an aperture having a first shape, providing a handle having a coupling surface having a second shape, providing a heated recess portion having a concavity with a peripheral shape similar to the first shape of the aperture and a coupling surface similar to the second shape, coupling the coupling surface of the handle to the coupling surface of the recess portion prior to cooling of the recess portion, cooling the recess portion to shrink fit the handle to the recess portion, and inserting the recess portion in the aperture of the outer cover.

19. The method of claim 18 wherein the coupling step includes creating a seam between the coupling surface of the handle and the coupling surface of the recess portion and the cooling step includes minimizing gaps in the seam.

20. The method of claim 19 and further comprising the steps of providing an inner component and coupling the outer cover to the inner component.

21. The method of claim 19 wherein the coupling surface of the recess portion is formed within the concavity.

22. The method of claim 18 wherein the provided recess portion includes a flange and further comprising the step of coupling the flange to the outer over to reinforce the cover adjacent the aperture.

23. A light apparatus for use in a medical procedure, the light apparatus comprising a reflector, an outer cover disposed over the reflector to provide a space therebetween, the outer cover including a plurality of surfaces defining a recess in the outer cover, a handle being at least partially disposed in the recess, the handle extending between side wall surface portions of the plurality of surfaces, a finger-receiving channel being defined between the handle and a base surface portion of the plurality of surfaces, a top wall surface portion of the plurality of surfaces overhanging at least a portion of the finger-receiving channel, and a bottom wall surface portion of the plurality of surfaces underlying at least a portion of the finger-receiving channel.

* * * * *